US006619016B1

(12) United States Patent
Sindermann et al.

(10) Patent No.: US 6,619,016 B1
(45) Date of Patent: Sep. 16, 2003

(54) METHOD FOR FILLING AND CAPPING CONTAINERS SUCH AS SCREW TOP BOTTLES AND THE SCREW TOP CLOSURES THEREFOR

(75) Inventors: Siegmar Sindermann, Kamen (DE); Markus Schaper, Dortmund (DE)

(73) Assignee: KHS Maschinen un Anlagenbau AG, Dortmund (DE)

( * ) Notice: Subject to any disclaimer, the term of this patent is extended or adjusted under 35 U.S.C. 154(b) by 114 days.

(21) Appl. No.: 09/590,351

(22) Filed: Jun. 8, 2000

Related U.S. Application Data

(63) Continuation-in-part of application No. 29/124,381, filed on Jun. 5, 2000, now Pat. No. Des. 448,297.

(30) Foreign Application Priority Data

| | | |
|---|---|---|
| Dec. 1, 1999 | (DE) | 199 60 860 |
| Dec. 3, 1999 | (DE) | 499 11 411 |
| Jun. 9, 1999 | (DE) | 199 26 293 |

(51) Int. Cl.[7] ..... B65B 31/04
(52) U.S. Cl. ..... 53/432; 53/426; 53/490
(58) Field of Search ..... 53/432, 426, 490, 53/289, 486, 167, 484, 488

(56) References Cited

U.S. PATENT DOCUMENTS

| | | | | | |
|---|---|---|---|---|---|
| 3,040,493 | A | * | 6/1962 | Wheaton | 53/167 |
| 3,477,192 | A | * | 11/1969 | Brown et al. | 53/432 |
| 3,494,094 | A | | 2/1970 | Downs et al. | |
| 4,545,496 | A | * | 10/1985 | Wilde et al. | 215/252 |
| 4,602,473 | A | * | 7/1986 | Hayashi et al. | 53/432 |
| 4,693,054 | A | * | 9/1987 | Spargo | 53/432 |
| 4,827,988 | A | * | 5/1989 | Gotz et al. | 141/103 |
| 4,840,014 | A | * | 6/1989 | Takehana et al. | 53/432 |
| 5,197,621 | A | * | 3/1993 | Bartl et al. | 215/331 |

FOREIGN PATENT DOCUMENTS

| | | | | |
|---|---|---|---|---|
| DE | 1782348 | * | 8/1968 | |
| DE | 1782348 | | 1/1972 | |
| GB | 628539 | | 8/1949 | |
| JP | 405042995 | * | 2/1993 | 53/426 |

* cited by examiner

*Primary Examiner*—Rinaldi I. Rada
*Assistant Examiner*—Thanh Truong
(74) *Attorney, Agent, or Firm*—Nils H. Ljungman & Associates

(57) ABSTRACT

This invention relates to a method for filling and capping containers, preferably screw top bottles, that are closed with a cap-like closing element preferably a screw cap. The invention achieves a more secure closure and a more hygienic mouth area. The method includes the following steps a) after the filling has been completed, the liquid in the bottles is allowed to foam, with minimized overflow of the foaming liquid, b) a first cap part is applied to the mouth of the bottle to stop the foam, thus forming a sealing fit on the mouth of the bottle, c) when the mouth of the bottle has been sealed by the first cap part, any traces of liquid and/or foam that may remain on the mouth of the bottle are sprayed, off, and d) the actual main cap is applied to the mouth of the bottle, without introducing any additional oxygen into the mouth of the bottle.

19 Claims, 5 Drawing Sheets

METHOD FOR FILLING AND CAPPING CONTAINERS SUCH AS SCREW TOP BOTTLES AND THE SCREW TOP CLOSURES THEREFOR

CONTINUING APPLICATION DATA

This application is a Continuation-In-Part application of U.S. Design patent application Ser. No. 29/124,381, filed on Jun. 5, 2000, now U.S. Pat. No. D448,297 entitled, "SCREW-TOP WITH CROWN CAPS REALIZED AT LEAST ON THE END AND SCREW-TOP CLOSER FOR SCREW-TOP BOTTLES AND OTHER CONTAINERS", having inventor Siegmar SINDERMANN, which claims priority from Federal Republic of Germany Design Patent Application No. 499 11 411.6, filed on Dec. 3, 1999. U.S. Design patent application Ser. No. 29/124,381, filed on Jun. 5, 2000, entitled, "SCREW-TOP WITH CROWN CAPS REALIZED AT LEAST ON THE END AND SCREW-TOP CLOSER FOR SCREW-TOP BOTTLES AND OTHER CONTAINERS", having inventor Siegmar SINDERMANN, was pending as of the filing date of the above-cited application.

BACKGROUND OF THE INVENTION

1. Field of the Invention

This invention relates to a method for filling and capping containers, preferably bottles, in which containers filled in a filling device are closed with a cap-like closing element that can be placed on the mouth end of a container, forming a sealing press fit or interference fit between the capping element and the container, and with a closure suitable for use with the method.

2. Background Information

Methods and devices of this type are used primarily in the beverage industry for filling and capping bottles, whereby the capping elements used are generally crown corks. To guarantee the long-term preservation of the bottled beverages, stringent requirements are set for the seal of the cap. Accordingly, a high sealing pressure is necessary between the crown cork and the bottle to be closed.

In conventional devices for filling and capping containers, the capping process inside the capping device can only be performed at a relatively long distance from the filling device, on account of the large dimensions of the capping device, which means that the filled bottles remain open for a relatively long period, during which time the liquid inside them is exposed to the ambient air. This ambient air can have a significant and adverse effect on the shelf-life and the taste of a bottled beverage.

Attempts have therefore been made to create capping devices that can be installed as close as possible to the bottling device or that can be integrated into the bottling device, so that the containers can be capped as soon as possible after the bottle has been filled with liquid.

In one known device of this type (British Patent 628 539), the capping device has only one single device to press the closures into the necks of the bottles, although the device in question has a complicated construction and takes up a considerable amount of vertical space, which means it is not possible to locate the closing device in the immediate vicinity of the point destined for the delivery of the filled containers from the bottle-filling machine to the discharge star wheel. The filled and not-yet-closed containers are therefore required to travel a considerable distance before they are closed. The result is that during the time it takes the bottle to travel this distance, the liquid inside is in contact with the atmosphere, and as a result of this surface contact between the liquid and the ambient air, there is an undesirable absorption of oxygen, and hygienic conditions can no longer be guaranteed. Furthermore, between the filling and the closing, the bottles are inevitably subjected to vibrations and impacts, as a result of which the liquid can be sloshed around inside the filled containers, thereby most frequently resulting in an overflowing or slopping of the liquid. This overflowing occurs in particular if the containers are made of plastic or plastic film, materials which are sensitive to impacts and collisions. With this device, however, it is not possible to close the bottles earlier, because the closing device is too tall to be located any closer to the bottle-filling machine.

U.S. Pat. No. 3,494,094 discloses a method in which a bottle, immediately after being filled, is closed in a first closing phase with a plastic closure part, over which a conventional crown cork is then placed in a second closing phase.

A method of the type described above is also disclosed in German Patent Publication Published for Opposition Purposes No. 17 82 348. This publication describes a method for closing bottles with plastic caps in two phases, whereby in the first phase, the plastic caps are pushed onto the bottles only far enough that the lateral skirts of the plastic caps just surround the thickest portion of the bead around the mouth of the bottle, and in the second phase they are pushed on all the way, so that the plastic cap closures come into contact with their end and base part against the edge of the mouth of the bottle.

OBJECT OF THE INVENTION

The object of this invention is to create a method of the type described above in which a more secure closure and a more hygienic mouth area can be achieved, in comparison to similar methods of the prior art.

SUMMARY OF THE INVENTION

The method taught by the invention is characterized by the features disclosed in the following steps. After the filling has been completed, the liquid in the bottles is allowed to foam, with minimized overflow of the foaming liquid, a first cap part is applied as a foam stopper to the mouth of the container, forming a sealing fit on the mouth of the container, when the mouth of the container has been sealed, any traces of liquid residue that may remain on the mouth of the bottle are sprayed, off, and the actual main cap is applied to the mouth of the bottle, without introducing any substantial additional oxygen into the mouth of the bottle. A capping element is provided, the inner sealing cap part of which is located in the lower portion of the actual cap, and this sealing part can be placed in sealing contact with the mouth of the bottle, whereupon the mouth of the bottle is cleaned, and then the cap is applied over the inner cap part and screwed to the mouth of the bottle. Following the application of the inner sealing cap part on the mouth by means of the capping machine, the mouth of the bottle is cleaned by means of sprayer devices that are stationary, rotate with the capping heads or are located in the capping machine. A sprayer device is applied to the mouth of the bottle, by means of which the end of the bottle is sealed and at least the vicinity of the cap is sprayed all around, following which caps filled with inert gas are applied to the mouth of the bottle.

In an independent realization, the invention teaches a screw cap that can be used with the method and is characterized by the fact that the bottles are closed with a cap that consists of a plurality of parts, whereby a first part of this cap is applied to the mouth of the bottle immediately after the filling and/or foaming of the bottle, whereupon the mouth of the bottle is cleaned and then the main closure is applied, whereby the two cap parts are connected to each other without adhesive and can be removed from the bottle as a complete and non-separating unit.

The method claimed by the invention and the screw cap suitable for use with the method make it possible to easily cap the bottle after the completion of the filling process and the foaming of the bottled liquid, or at the beginning of the pre-capping process, which is then followed by the main capping, which is preceded by a spraying of the mouth area of the bottle, outside the area of the bottling machine or directly inside the capping machine. The consumer can remove this cap as a complete unit, in which no adhesives or similar substances are used to connect the two parts of the cap to each other, and which can represent a health hazard, in beverages in particular. Furthermore, for carbonated beverages in particular, which have a desirable tendency to foam, it is possible to perform a proper cleaning of the neck of the bottle or the area of the mouth before the primary capping. Finally, the air in the screw cap is not pushed into the bottle, which further reduces the amount of oxygen in the neck of the bottle.

Using this method and the following method characterized by the fact that a capping element is provided, the inner sealing cap part of which is located in the lower portion of the actual cap, and this sealing part can be placed in sealing contact with the mouth of the bottle, whereupon the mouth of the bottle is cleaned, and then the cap is applied over the inner cap part and screwed to the mouth of the bottle, it is also possible to perform a pre-sealing in the capping machine, with a subsequent spraying of the mouth area, followed by a final capping of the bottle. In both cases, the method ensures that any remaining liquid will be removed from the area of the mouth.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The figures further illustrate the invention by way of example.

DESCRIPTION OF THE PREFERRED EMBODIMENT

The invention is explained in greater detail below with reference to the exemplary embodiment of the closure that is illustrated in the accompanying drawing.

Figure 1:
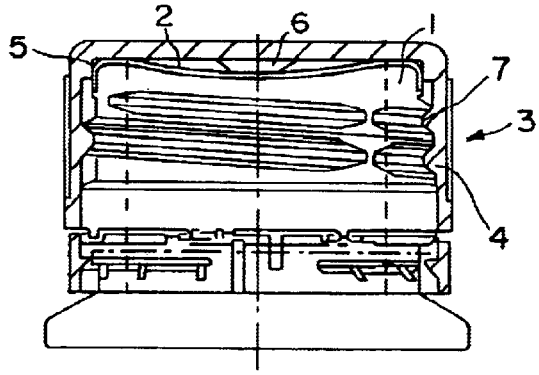
FIG. 1 shows a screw cap tightened onto a screw top bottle.

FIG. 1 shows a screw cap tightened onto a screw top bottle.

The containers are processed in a standard bottling machine, in which they are, for example, flushed with $CO_2$, evacuated, pre-pressurized and filled with the liquid in question. When the bottling machine in question is a rotating machine, a transfer star is located in the exit area, the pockets of which at least partly surround the containers and discharge them onto a conveyor belt that is realized in the form of a plate conveyor. While the bottles are in this transfer star, the liquid is allowed to foam to expel the oxygen contained in the neck of the bottle. Immediately thereafter or in the capping machine, according to FIGS. 1, 3 and 4 the mouths 1 of the bottles are sealed with a first part or sealing part 2 of a cap 3 and are then sprayed with liquid, so that any remaining foam can be removed and the following second part 4 of the cap 3 can be screwed on under proper hygienic conditions.

Now we refer to FIG. 1 for understanding of the next paragraphs.

The first part 2 of the cap 3 is picked up from a feed trough and is pressed onto the mouth of the bottle. After the mouth area of the bottle has been cleaned, the second part 4 of the cap 3 can be applied in the conventional manner, for example by means of a screw cap closer.

The first part 2 of this cap 3 is preferably realized in the form of a cap, and after the first part 2 is applied it encloses the upper mouth of a container. In the second step, the second, outer part 4 is applied to form the actual main cap 3. This second part 4 has, on its end side, a recess 5 into which, during the application, the cap part 2 is introduced, centered and clamped in place. Such a clamping can be accomplished, for example, by deforming the first part 2 or by a corresponding spreading of deformable wall parts of the first part 2 or of corresponding parts of the main closure. For this purpose, the invention teaches that on the lower end of the outer part 4 there is a raised portion 6 which acts on the end of the first part 2 and thus effects a clamping or deformation to achieve the clamping. The clamp connection can additionally be supported by the fact that the outside diameter of the first part 2 is greater than the inside diameter of the internal thread 7 of the outer part 4.

Figure 2:
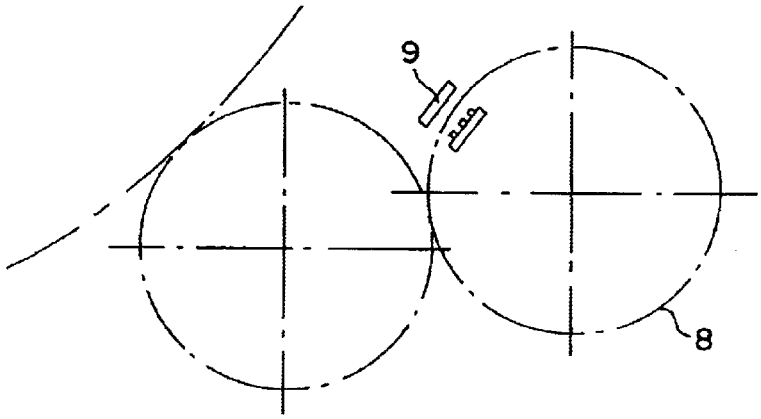
FIG. 2 shows a capping machine with spraying devices.

FIG. 2 shows a capping machine with spraying devices.

Figure 3:
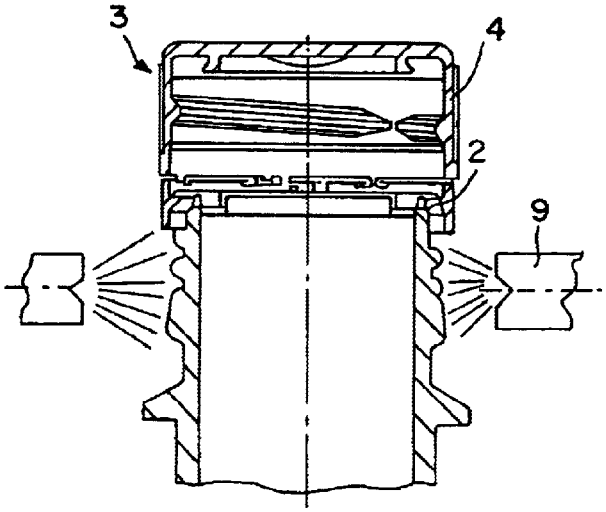
FIG. 3 shows spraying devices cleaning the screw threads on the top of a bottle with a cap according to the invention, initially sealing the mouth of the bottle.

FIG. 3 shows spraying devices cleaning the screw threads on the top of a bottle with a cap according to the invention, initially sealing the mouth of the bottle.

Figure 4:
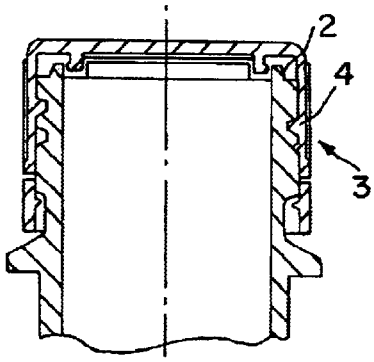
FIG. 4 shows the screw cap of FIG. 3 tightened onto a screw top bottle.

FIG. 4 shows the screw cap of FIG. 3 tightened onto a screw top bottle.

In the embodiment of the invention illustrated in FIGS. 2–4, the cap is applied to the mouth 1 without the use of any additional devices, preferably right in the capping machine 8. The sealing part 2 of the closure, as illustrated in FIG. 3, is thereby located in the lower portion of the actual cap part 3, and after it has been picked up by the capping heads, the sealing part 2 is initially applied in sealed contact against the end of the mouth. This sealing process can be accomplished by pressing or by direct pressure from the sealing part 2, so that the mouth of the bottle is already finally closed. Then the external portion of the mouth can be cleaned by spraying devices 9, whereupon the outer cap part 4 is applied or screwed on. For this purpose, corresponding contours can be provided on the cylindrical portion of the sealing part 2 of the cap which make it possible to screw on or otherwise attach the cap easily, and also guarantee a solid connection between the two parts 2 and 4 after the capping process has been completed.

The spraying devices 9 can be stationary, or they can rotate with the capping heads, or they can be located in the capping heads.

Figure 6:
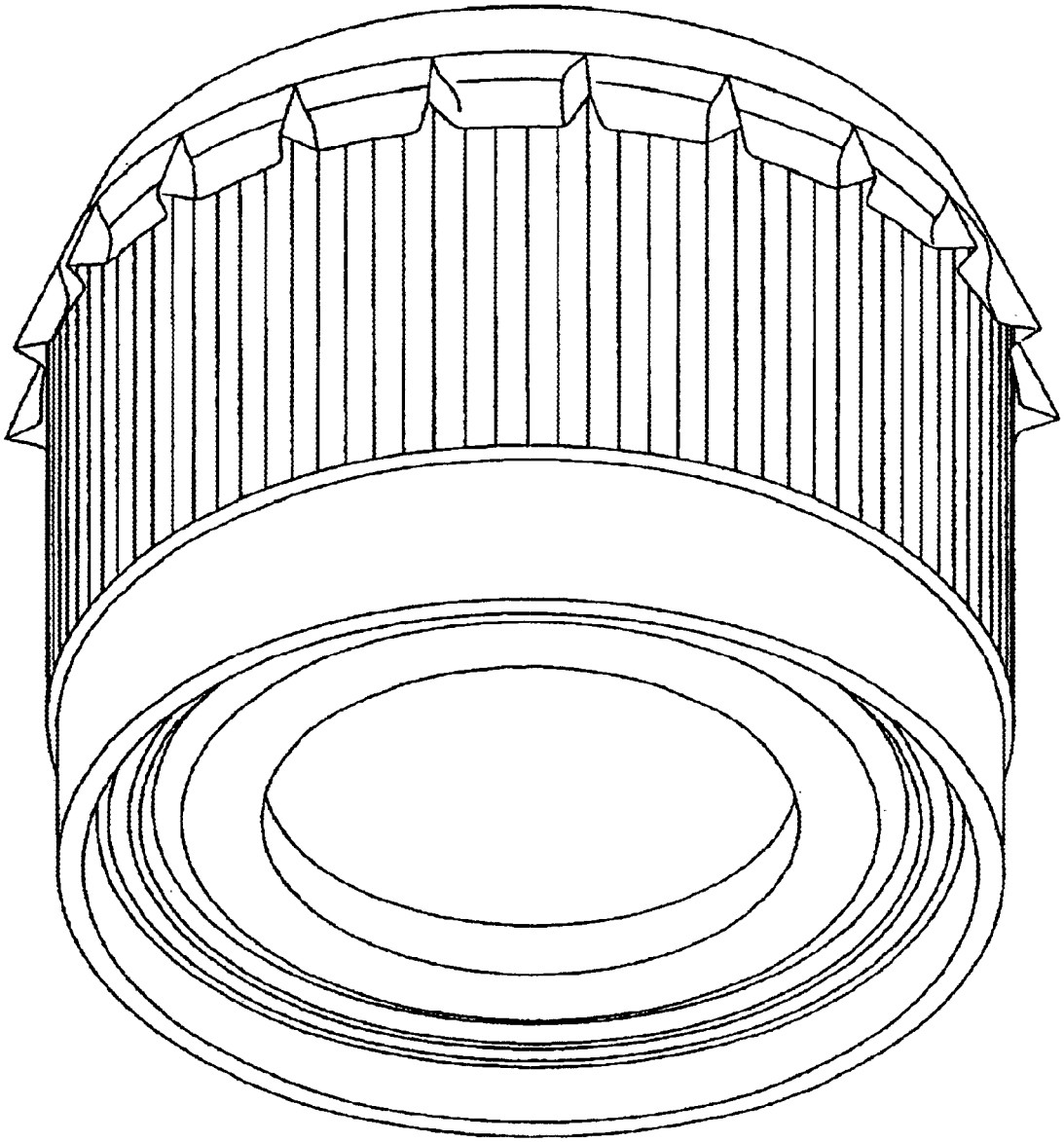
FIG. 6 shows another perspective view of a screw cap.

FIG. 6 is a bottom perspective view of the screw-top showing the bottom of the sealing element ready for application to a bottle.

Figure 5:
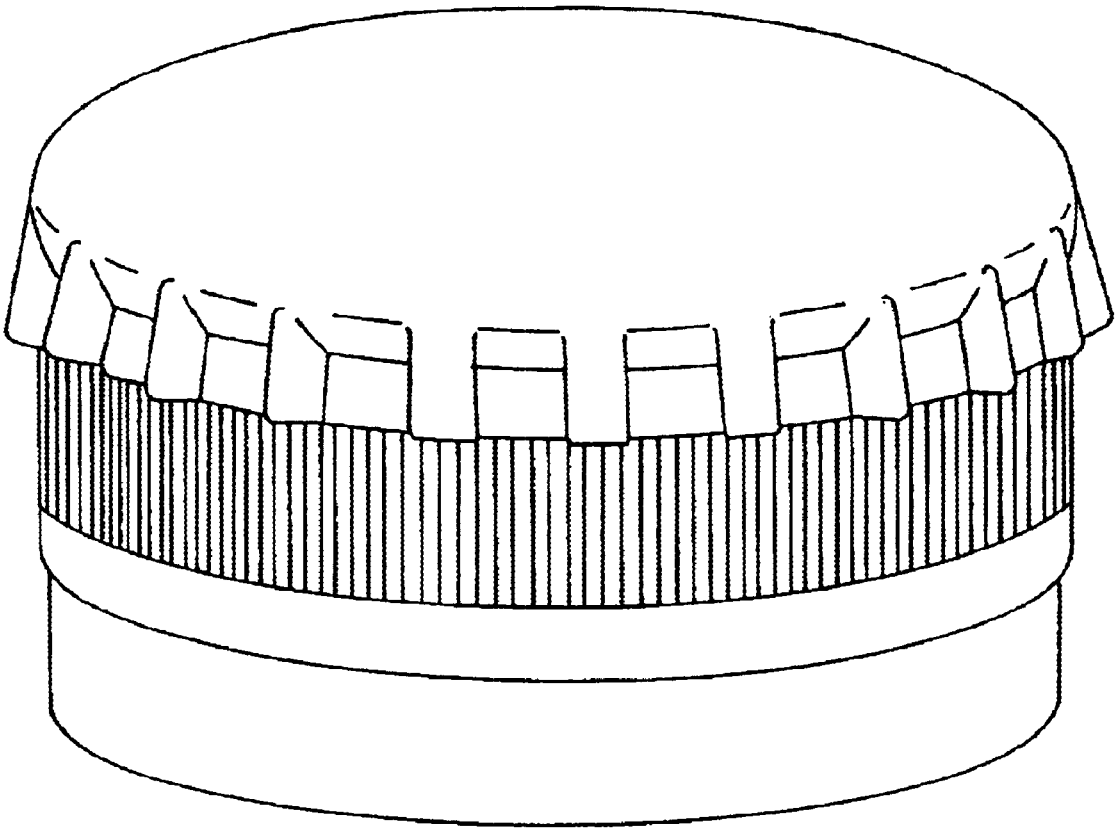
FIG. 5 shows a perspective view of a screw cap.

FIG. 5 is a perspective view of the screw-top with the top and side visible.

One feature of the invention resides broadly in the method for filling and capping containers, preferably bottles, in which containers filled in a filling device are closed with a cap-like closure element that can be placed on the mouth end of a container, forming a sealing press fit between the capping element and the container, characterized by the following steps:

a) after the filling has been completed, the liquid in the bottles is allowed to foam, with minimized overflow of the foaming liquid, b) a first cap part is applied as a foam stopper to the mouth of the bottle, forming a sealing fit on the mouth of the bottle, c) when the mouth of the bottle has been sealed, any traces of liquid and/or foam that may remain on the mouth of the bottle are sprayed, off, and d) the actual main cap is applied to the mouth of the bottle, without introducing any additional oxygen into the mouth of the bottle.

Figure 7:
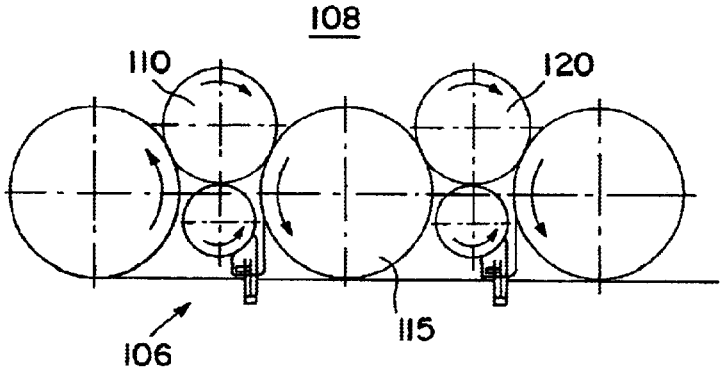
FIG. 7 shows the capping portion of a bottling mechanism.

FIG. 7 shows the capping portion 106 of a bottling mechanism 108. The sealing part of the sealing mechanism 110 is connected to cap part applying mechanism 120 by a transport mechanism 115. The transport mechanism 115 is located between the sealing part of the sealing mechanism 110 and the cap part applying mechanism 120.

Figure 8:
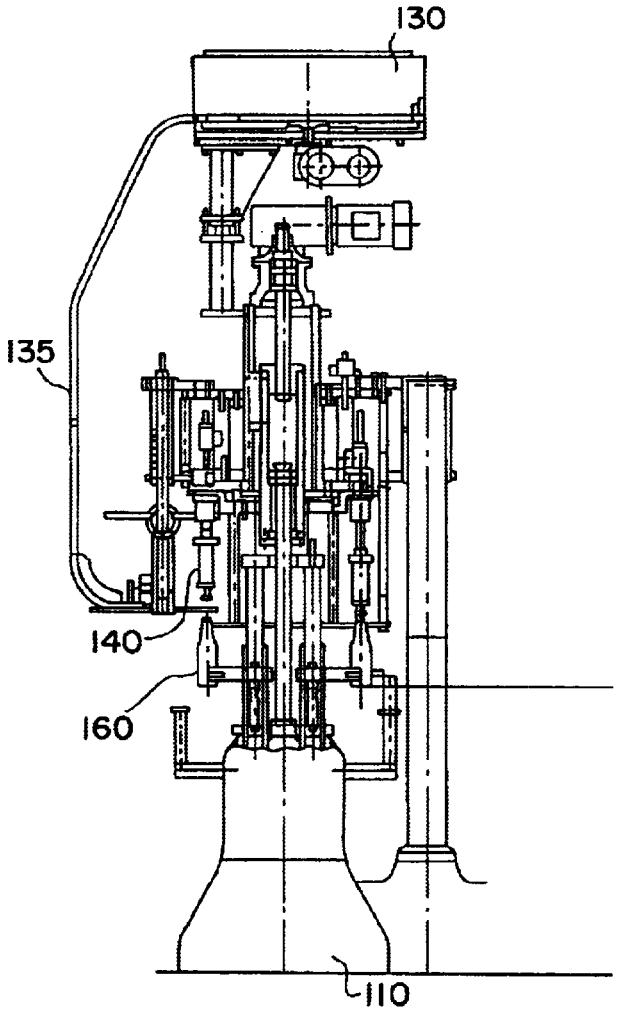
FIG. 8 shows a bottle sealing mechanism.

FIG. 8 shows a bottle sealing mechanism 110. A feed trough 130 is located at the top of the bottle sealing mechanism. The sealing part travels from the feed trough 130 to a sealing part picking up mechanism 140 through a transport mechanism 135. The sealing part picking up mechanism 140 applies the sealing part to the mouth of the bottle 160 to form a seal on the mouth of the bottle 160.

Figure 9:
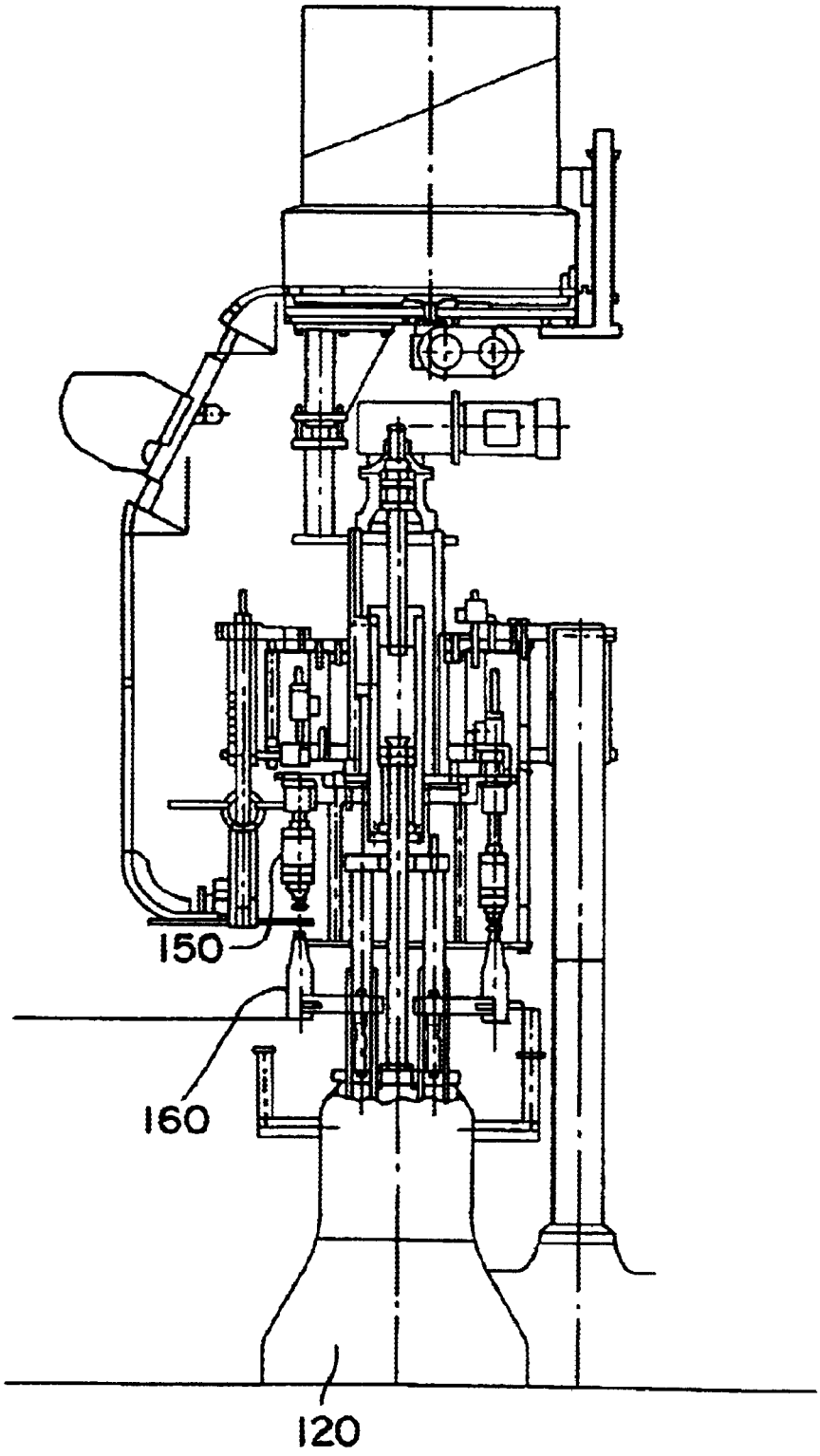
FIG. 9 shows a bottle capping mechanism.

FIG. 9 shows a bottle capping mechanism 120. A cap part picking up mechanism 150 applies a cap part to the mouth of the bottle 160 upon completion of the step of spraying the mouth of the bottle 160.

Another feature of the invention resides broadly in the method characterized by the fact that a capping element is provided, the inner sealing cap part of which is located in the lower portion of the actual cap, and this sealing part can be placed in sealing contact with the mouth of the bottle, whereupon the mouth of the bottle is cleaned, and then the cap is applied over the inner cap part and screwed to the mouth of the bottle.

Yet another feature of the invention resides broadly in the method characterized by the fact that following the application of the inner sealing cap part on the mouth by means of the capping machine, the mouth of the bottle is cleaned by means of sprayer devices that are stationary, rotate with the capping heads or are located in the capping machine.

Still another feature of the invention resides broadly in the method characterized by the additional steps:

a) a sprayer device is applied to the mouth of the bottle, by means of which the end of the bottle is sealed and at least the vicinity of the cap is sprayed all around, following which b) caps filled with inert gas are applied to the mouth of the bottle.

A further feature of the invention resides broadly in the method characterized by the fact that the first cap part is removed from the mouth of the bottle, preferably automatically, and is pressed in a sealed manner against it, whereupon the remaining area of the mouth is cleaned, and then the second part of the cap can be applied to the mouth of the bottle.

A further feature of the invention resides broadly in the method characterized by the fact that the first cap part is placed adjacent the mouth of the bottle, preferably automatically, and is pressed in a sealed manner against it, whereupon the remaining area of the mouth is cleaned, and then the second part of the cap can be applied to the mouth of the bottle.

Another feature of the invention resides broadly in the method characterized by the fact that the inner sealing cap part is pressed in a sealed manner on the mouth, and the outer cap can be applied rotationally to the mouth of the bottle over the inner cap part.

Yet another feature of the invention resides broadly in the method for filling and capping containers, preferably bottles, in which containers filled in a filling device are closed with a cap-like closure element that can be placed on the mouth end of a container, forming a sealed press fit between the capping element and the container, characterized by the fact that the bottles are capped with a cap that consists of a plurality of parts, and a first part of this cap is placed on the mouth of the bottle immediately after the filling has been completed and/or the liquid in the bottles has foamed, the mouth is cleaned and then the main cap is applied, whereby the two parts of the cap are connected to each other without adhesive and can be removed from the bottle as a complete unit.

Still another feature of the invention resides broadly in the method characterized by the fact that the first part is realized so that it can be connected in sealed contact with the mouth of the bottle and can be engaged with the main part of the cap.

A further feature of the invention resides broadly in the screw cap for use in a method characterized by the fact that the main cap is realized in the form of a screw cap.

Another feature of the invention resides broadly in the screw cap for capping containers consisting of a first inner part and a second outer part, characterized by the fact that the inner part 2 is realized in the form of a cap that surrounds the mouth 1 of the bottle, and the second, outer part 4 is realized in the form of a main cap that can be applied to the mouth 1 of the bottle, whereby the latter, on its inner end side, has a recess 5 into which the first part can be introduced in a clamping connection.

Yet another feature of the invention resides broadly in the screw cap characterized by the fact that the inner part 2 is clamped by the deformation of its end side.

Still another screw cap characterized by the fact that the inner part 2 is clamped by spreading of deformable wall parts.

A further feature of the invention resides broadly in the screw cap characterized by the fact that the clamping and/or spreading is accomplished by an elevated portion 6 on the lower end of the second, outer part 4.

Another feature of the invention resides broadly in the screw cap characterized by the fact that the outside diameter of the first part 2 is greater than the inside diameter of the internal thread 7 of the outer part 4.

Yet another feature of the invention resides broadly in the screw cap characterized by the fact that the inner cap part, on its cylindrical surface, has at least one thread turn over which the cap can be screwed and is connected to the cap.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The patents, patent applications, or patent publications, which were cited in the German Search Report are hereby incorporated by reference as if set forth in their entirety herein.

The corresponding foreign patent publication applications, namely, Federal Republic of Germany Patent Application No. P 199 26 293.4, filed on Jun. 9, 1999, having inventors Siegmar Sindermann and Dr. Markus Schaper, and DE-OS P 199 26 293.4 and DE-PS P 199 26 293.4, and P 199 60 860.1, filed on Dec. 1, 1999, having inventors Siegmar Sindermann and Dr. Markus Schaper, and DE-OS P 199 60 860.1, and DE-PS P 199 60 860.1, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

U.S. patent application Ser. No. 29/124,381, filed on Jun. 5, 2000, issued on Sep. 25, 2001 as U.S. Design Pat. No. D448,297, having inventors Siegmar Sindermann and Markus Schaper, entitled "Screw-top with crown caps realized at least on the end and screw-top closer for screw-top bottles and other containers," and claiming priority from Federal Republic of Germany Patent Application No. 499 11 411.6, is hereby incorporated by reference as if set forth in its entirety herein.

U.S. Patents relating to screw cap machines or devices may be found in the following U.S. Patent Nos. U.S. Pat. No. 5,230,427, entitled "Sterilizable hermetically-sealed substantially glass container"; U.S. Pat. No. 4,172,397, entitled "Machine for de-capping containers"; U.S. Pat. No. 5,408,801, entitled "Outboard bottle support apparatus for bottle capping machines"; U.S. Pat. No. 4,222,215, entitled "Screw-capping device"; U.S. Pat. No. 5,490,369, entitled "Capping head with magnetic clutch"; U.S. Pat. No. 5,197,619, entitled "Device for closing, with a security seal, a container of a rigid material, such as glass, by means of a screw cap of rigid thermoplastics material"; U.S. Pat. No. 5,054,261, entitled "Cap chucks for use with bottle capping machines"; and U.S. Pat. No. 4,765,119, entitled "Screw capping machine with vertically reciprocable container platform". These devices may be used with an embodiment of the invention. These devices may be used at applicants' option with an embodiment of the invention.

Screw capping machines are available from "Cozzoli Machine Company". Some other Cozzoli patents are as follows: U.S. Pat. No. 4,640,322, entitled "Method and apparatus for filing a receptacle with a material"; U.S. Pat. No. 4,570,822, entitled "Computer operated filling system"; U.S. Pat. No. 4,185,732, entitled "Arrangements for and methods of improving ampul handling capacity in ampul processing machines"; and U.S. Pat. No. 4,096,683, entitled "Ampoule filling and sealing machine".

U.S. patents relating to Screw caps are as follows: U.S. Pat. No. 6,039,199, issued Mar. 21, 2000 to Jordi; U.S. Pat. No. 6,006,930, issued Dec. 28, 1999 to Dreyer, et al.; U.S. Pat. No. 5,984,123, issued Nov. 16, 1999 to Mogami, et al.; U.S. Pat. No. 5,975,321, issued Nov. 2, 1999 to Luch; U.S. Pat. No. 5,913,436, issued Jun. 22, 1999 to Breuer; U.S. Pat. No. 5,875,909, issued Mar. 2, 1999 to Guglielmini; U.S. Pat. No. 4,946,055, issued Aug. 7, 1990 to Towns, et al.; U.S. Pat. No. 4,489,845, issued Dec. 25, 1984 to Aichinger, et al.; U.S. Pat. No. 4,412,409, issued Nov. 11, 1983 to Aichinger, et al.; U.S. Pat. No. 4,371,091, issued Feb. 1, 1983 to Gelina; U.S. Pat. No. 4,310,101, issued Jan. 12, 1982 to Sekine; U.S. Pat. No. 4,253,581, issued Mar. 3, 1981 to Aichinger, et al.; U.S. Pat. No. 4,210,251, issued Jul. 1, 1980 to Grussen; U.S. Pat. No. 4,090,631, issued May 23, 1978 to Grussen; and U.S. Pat. No. 4,016,996, issued Apr. 12, 1977 to Aichinger, et al. These devices may be used with an embodiment of the invention. These devices may be used at applicants' option with an embodiment of the invention.

Some examples of capping machines which may be utilized or adapted for use in at least one possible embodiment of the present invention may be found in the following U.S. patents: U.S. Pat. No. 6,058,985, entitled "Bottling machine with a set-up table and a set-up table for a bottling machine and a set-up table for a bottle handling machine"; U.S. Pat. No. 6,044,626, entitled "Chuck for capping machine"; U.S. Pat. No. 6,041,571, entitled "Magnetic coupling for a capping apparatus"; U.S. Pat. No. 6,023,910, entitled "Capping machine"; U.S. Pat. No. 6,006,933, entitled "Twist-off closure"; U.S. Pat. No. 5,996,311, entitled "Device for tightening caps on containers"; U.S. Pat. No. 5,975,320, entitled "Tamper-evident closures and container neck therefor"; U.S. Pat. No. 5,967,352, entitled "Interrupted thread cap structure"; U.S. Pat. No. RE36,334, entitled "Tamper-evident twist-off closure"; U.S. Pat. No. 5,950,850, entitled "Sealing device and container"; U.S. Pat. No. 5,937,616, entitled "Vial capping machine"; U.S. Pat. No. 5,934,042, entitled "Anti-rotation wear plate for capping machine"; U.S. Pat. No. 5,918,442, entitled "In-line capping machine"; U.S. Pat. No. 5,915,526, entitled "Safety apparatus for in-line capping machine"; U.S. Pat. No. 5,915,524, entitled "Conveyor for a container filling/capping machine"; U.S. Pat. No. 5,826,400, entitled "Plastic bottle rotation restraint for capping machine"; U.S. Pat. No. 5,816,029, entitled "Anti-rotation device for capping machine"; U.S. Pat. No. 5,806,656, entitled "Container rotation arrester"; U.S. Pat. No. 5,772,001, entitled "Star wheel system"; U.S. Pat. No. 5,755,348, entitled "Snap-on, screw-off cap and container neck"; U.S. Pat. No. 5,732,528, entitled "Container guide for a filling and capping machine"; U.S. Pat. No. 5,676,270, entitled "Threaded container torque retention system for use with a threaded closure"; U.S. Pat. No.

5,669,209, entitled "In-line capping machine"; U.S. Pat. No. 5,540,320, entitled "Adjustable star and guide conveyor system"; U.S. Pat. No. 5,533,608, entitled "Quick-change center star assembly for a capping machine"; U.S. Pat. No. 5,531,057, entitled "Bottle cap delivery system"; U.S. Pat. No. 5,529,209, entitled "Easy load elevating hopper"; U.S. Pat. No. 5,528,879, entitled "Apparatus for applying closures to containers"; U.S. Pat. No. 5,490,369, entitled "Capping head with magnetic clutch"; U.S. Pat. No. 5,457,936, entitled "Cap tightening turrent"; U.S. Pat. No. 5,456,376, entitled "Snap-on, screw off cap and container neck"; U.S. Pat. No. 5,437,140, entitled "Auto rotation capping chuck improvement"; U.S. Pat. No. 5,437,139, entitled "Capping machine head with cap aligning chuck"; U.S. Pat. No. 5,423,159, entitled "Pivoting roller assembly for tightening container caps"; U.S. Pat. No. 5,419,094, entitled "Constant speed spindles for rotary capping machine"; U.S. Pat. No. 5,417,031, entitled "Apparatus for rotating cylindrical caps onto containers"; U.S. Pat. No. 5,400,564, entitled "Capping machine"; U.S. Pat. No. 5,398,485, entitled "Bottle support mechanism for a capping machine"; U.S. Pat. No. 5,398,480, entitled "Device for stabilizing caps while being attached to containers"; U.S. Pat. No. 5,373,934, entitled "Bottle-gripping insert element"; U.S. Pat. No. 5,327,697, entitled "Chuck for capping machine"; U.S. Pat. No. 5,313,765, entitled "Capping machine head with magnetic clutch"; U.S. Pat. No. 5,309,694, entitled "Device for use with a closure magazine for introducing closures into a closure channel"; U.S. Pat. No. 5,301,488, entitled "Programmable filling and capping machine"; and U.S. Pat. No. 5,285,618, entitled "Apparatus for separating and making available closure elements". These devices may be used with an embodiment of the invention. These devices may be used at applicants' option with an embodiment of the invention.

Some examples of machines used in filling containers may be found in the following U.S. patents: U.S. Pat. No. 5,413,153, issued May 9, 1995 to Zwilling, et al., entitled "A container filling machine for filling open-top containers, and a filler valve therefore"; U.S. Pat. No. 5,558,138, issued Sep. 24, 1996 to Stock, et al., entitled "Process and apparatus for cleaning container handling machines such as beverage can filling machines"; and U.S. Pat. No. 5,634,500, issued Jun. 3, 1997 to Clusserath, et al., entitled "Method for bottling a liquid in bottles or similar containers".

The details in these above-cited patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

This invention relates to a method for filling and capping containers, preferably bottles, that are closed with a cap-like closing element. Compared to methods of the prior art, the method claimed by the invention achieves a more secure closure and a more hygienic mouth area. The method includes the following steps: a) after the filling has been completed, the liquid in the bottles is allowed to foam, with minimized overflow of the foaming liquid, b) a first cap part is applied to the foam stopper to the mouth of the bottle, forming a sealing fit on the mouth of the bottle, c) when the mouth of the bottle has been sealed, any traces of liquid and/or foam that may remain on the mouth of the bottle are sprayed, off, and d) the actual main cap is applied to the mouth of the bottle, without introducing any additional oxygen into the mouth of the bottle.

The invention as described hereinabove in the context of the preferred embodiments is not to be taken as limited to all of the provided details thereof, since modifications and variations thereof may be made without departing from the spirit and scope of the invention.

What is claimed is:

1. A method for filling and capping containers in which containers filled in a filling device are closed with a closure element that is configured to be placed on the mouth portion of a container, said closure element comprising a sealing part, said sealing part being configured to form a sealing press fit over an opening in the mouth portion of said container, and a cap part, said cap part being configured to be placed about the mouth portion of the container to hold said sealing part against the mouth portion, said method comprising the steps of:

filling a container with a liquid;

allowing said liquid to foam in said container to expel oxygen from said container while minimizing overflow of foam from said container;

applying said sealing part to the mouth portion of said container to seal the opening in the mouth portion of said container to restrict foam from overflowing from said container and to restrict entry of oxygen into the mouth portion of said container;

spraying the mouth portion of said container to remove substantially any traces of at least one of liquid and foam from the mouth portion of said container after sealing the opening in the mouth portion of said container with said sealing part; and applying said cap part at the mouth portion of said container while said sealing part is sealing the opening in the mouth portion and driving said cap part onto the mouth portion while relatively moving the sealing part up from a location at the bottom of the cap part to the top of the cap part without introducing any substantial additional oxygen from the cap part into the mouth portion of said container and finally holding said sealing part against the mouth portion of said container with said cap part and sealing said container.

2. The method according to claim 1, wherein said sealing part is physically separate from said cap part, and wherein said method further comprises the steps of:

picking up said sealing part separately from said cap part, preferably automatically, from a feed trough prior to applying said sealing part to the mouth of said container to form a seal on the mouth of said container; and picking up said cap part separately from said sealing part.

3. The method according to claim 2, wherein said method further comprises the step of mechanically connecting said sealing part and said cap part to each other, subsequent to initiation of said step of applying said cap part, to permit removal of said two-part closure element as a complete integral unit.

4. The method according to claim 3, wherein said sealing part is substantially flat and is configured to extend substantially directly across the mouth of said container to form a seal over the mouth of said container, and wherein said method further comprises the steps of:

applying said sealing part to extend substantially directly across the mouth of said container to form a seal on the mouth of said container; and applying said cap part over said sealing part upon completion of said step of spraying the mouth of said container.

5. The method according to claim 4, wherein said method further comprises the step of filling said cap part with inert gas prior to said step of applying said cap part to the mouth of said container.

6. The method according to claim 5, wherein said cap part is a screw cap, and wherein said step of applying said cap part further comprises the step of screwing said cap part onto the mouth of said container.

7. The method according to claim 6, wherein:

said step of applying said sealing part to form a seal on the mouth of said container comprises applying said sealing part with a capping machine; and said step of cleaning the mouth of said container comprises cleaning the mouth of said container with sprayer devices, which said sprayer devices are one of: stationary, rotatable with the capping heads, or located in the capping machine.

8. The method according to claim 1, wherein said sealing part is configured to be connected in sealed contact with the mouth of said container and is configured to be engaged with said cap part of said closure element.

9. The method according to claim 8, wherein said cap part is a screw cap.

10. The method according to claim 9, wherein said sealing part is substantially flat and is configured to extend substantially directly across the mouth of said container to form a seal over the mouth of said container.

11. A method for filling and capping containers in which containers filled in a filling device are closed with a closure element that is configured to be placed on the mouth portion of a container, said closure element comprising a sealing part, said sealing part being configured to form a seal over an opening in the mouth portion of said container, and a cap part, said cap part being configured to be placed about the mouth portion of the container to hold said sealing part against the mouth portion, said method comprising the steps of:

filling a container with a liquid;

allowing said liquid to foam in said container to expel oxygen from said container while minimizing overflow of foam from said container;

applying a sprayer device to the mouth portion of said container, by means of which the opening in the mouth portion of said container is sealed with said sealing part and at least the vicinity of said sealing part is sprayed all around;

filling said cap part with inert gas; and applying said cap part filled with inert gas to the mouth portion of said container upon completion of spraying of the mouth portion of said container while said sealing part is sealing the opening in the mouth portion and driving said cap part onto the mouth portion while relatively moving the sealing part up from a location at the bottom of the cap part to the top of the cap part without introducing any substantial additional oxygen into the mouth portion of said container and finally holding said sealing part against the mouth portion of said container with said cap part and sealing said container.

12. The method according to claim 11, wherein said cap part is a screw cap, and wherein said step of applying said cap part further comprises the step of screwing said cap part onto the mouth of said container.

13. The method according to claim 12, wherein said sealing part is substantially flat and is configured to extend substantially directly across the mouth of said container to form a seal over the mouth of said container.

14. A method for filling and capping containers in which containers filled in a filling device are closed with a closure element that is configured to be placed on the mouth portion of a container, said closure element comprising a sealing part, said sealing part being configured to form a sealing press fit over an opening in the mouth portion of said container, and a cap part, said cap part being configured to be placed about the mouth portion of the container to hold said sealing part against the mouth portion, said method comprising the steps of:

filling a container with a liquid;

applying said sealing part to the mouth portion of said container to seal the opening in the mouth portion of said container to restrict entry of oxygen into the mouth portion of said container;

spraying the mouth portion of said container to remove substantially any traces of at least one of: liquid and foam from the mouth portion of said container after sealing the opening in the mouth portion of said container with said sealing part; and applying said cap part at the mouth portion of said container while said sealing part is sealing the opening in the mouth portion and driving said cap part onto the mouth portion while relatively moving the sealing part up from a location at the bottom of the cap part to the top of the cap part without introducing any substantial additional oxygen from the cap part into the mouth portion of said container and finally holding said sealing part against the mouth portion of said container with said cap part and sealing said container.

15. The method according to claim 14, wherein said sealing part is substantially flat and is configured to extend substantially directly across the mouth of said container to form a seal over the mouth of said container.

16. The method according to claim 15, wherein said method further comprises the step of mechanically connecting said sealing part and said cap part to each other, subsequent to initiation of said step of applying said cap part, to permit removal of said two-part closure element as a complete integral unit.

17. The method according to claim 16, wherein said method further comprises the steps of:

allowing the liquid to one of: foam or not foam; and placing said sealing part on the mouth of said container immediately after at least one of (a) and (b):

(a) completion of said step of filling said container; and (b) completion of said step of allowing the liquid to foam.

18. The method according to claim 17, wherein said cap part is a screw cap, and wherein said step of applying said cap part further comprises the step of screwing said cap part onto the mouth of said container.

19. The method according to claim 18, wherein said sealing part and said cap part are mechanically connected to each other without adhesive.

* * * * *